US007458171B1

(12) United States Patent
Lentz

(10) Patent No.: US 7,458,171 B1
(45) Date of Patent: Dec. 2, 2008

(54) DEHUMIDIFIER CLOTHES DRYER APPARATUS

(76) Inventor: Luke E. Lentz, 39 Boundary Ave., Red Lion, PA (US) 17356

( * ) Notice: Subject to any disclaimer, the term of this patent is extended or adjusted under 35 U.S.C. 154(b) by 185 days.

(21) Appl. No.: 11/668,424

(22) Filed: Jan. 29, 2007

(51) Int. Cl.
*F26B 21/06* (2006.01)

(52) U.S. Cl. ..... 34/75; 34/595

(58) Field of Classification Search ..... 34/75, 34/595

See application file for complete search history.

(56) References Cited

U.S. PATENT DOCUMENTS

| | | | | |
|---|---|---|---|---|
| 4,603,489 | A * | 8/1986 | Goldberg | 34/77 |
| 4,640,022 | A | 2/1987 | Suzuki et al. | |
| 5,042,171 | A | 8/1991 | Obata et al. | |
| 5,107,606 | A * | 4/1992 | Tsubaki et al. | 34/596 |
| 5,343,632 | A * | 9/1994 | Dinh | 34/507 |
| D360,716 | S | 7/1995 | Ertz et al. | |
| 6,005,227 | A | 12/1999 | Pappas | |
| 7,020,985 | B2 * | 4/2006 | Casey et al. | 34/595 |
| 7,055,262 | B2 * | 6/2006 | Goldberg et al. | 34/86 |
| 2002/0023368 | A1 * | 2/2002 | Beaumont | 34/79 |
| 2003/0233766 | A1 | 12/2003 | Bolduan et al. | |
| 2005/0278972 | A1 | 12/2005 | Maruca | |
| 2007/0039358 | A1 * | 2/2007 | Mills et al. | 68/18 F |

* cited by examiner

*Primary Examiner*—S. Gravini
(74) *Attorney, Agent, or Firm*—Crossley Patent Law; Mark A. Crossley

(57) ABSTRACT

The dehumidifier clothes dryer apparatus provides for drying clothes with a closed loop air system. The system does not require an external air source, nor does the system require an exhaust, the apparatus thereby not constrained as to location. The compressor system provides for condensing moisture from air passed through the clothes within the drug, the moisture collected in a sump tank for removal, optionally with a float controlled sump pump. Dual lint traps with optional removable filters insure proper operation. An optional accessory heating coil is provided. Relatively low energy requirements allow 110 volt operation.

18 Claims, 4 Drawing Sheets

DEHUMIDIFIER CLOTHES DRYER APPARATUS

BACKGROUND OF THE INVENTION

Considering the clothes dryers existing in the art, a need exists for an improved clothes dryer which requires no exhaust air outlet. Exhaust outlets require strategic positioning of clothes dryers which provides exhausting humid air to an environment external to that of the dryer. Such clothes dryers also, then, require a fresh air supply to replace exhausted air. Additionally, these clothes dryers typical in the art operate best in a dry climate. Typical clothes dryers further require significant amounts of heat to heat the air used to dry the clothes in order to extract moisture. Energy costs and increased heat and humidity of exhausted air are only two of the undesirable results. What is needed is an improved clothes dryer which recycles drying air, and therefore can be located as desired. Further, the improved dryer, as a result of lessened energy demand, should operate on 110 voltage, rather than 220 volts. In addition, the improved dryer should not require excessive heat in order to dry clothes, as do most dryers in the art.

1. Field of the Invention

The dehumidifier clothes dryer apparatus relates to clothes dryers and more especially to a dehumidifying clothes dryer apparatus which requires no exhaust air outlet and which operates with minimal heat.

2. Description of the Prior Art

Prior related art does not teach a device which operates in with closed loop air as does the present apparatus. U.S. Pat. No. 4,640,022 issued to Suzuki et al. on 1987 Feb. 3 teaches a clothes dryer which requires continual supply of external air. U.S. Pat. No. 5,042,171 issued to Obata et al. on 1991 Aug. 27 teaches a clothes dryer which utilizes water as a dehumidifier of humid air. The device is more complex than the present invention and requires water in order to operate. U.S. Pat. Publication No. 2005/0278972A1 issued to Maruca on 2005 Dec. 22 teaches a low temperature clothes dryer which is not a drum design.

While the above-described devices fulfill their respective and particular objects and requirements, they do not describe a dehumidifier clothes dryer apparatus that provides for the advantages of the present dehumidifier clothes dryer apparatus. In this respect, the present dehumidifier clothes dryer apparatus substantially departs from the conventional concepts and designs of the prior art. Therefore, a need exists for an improved dehumidifier clothes dryer apparatus.

SUMMARY OF THE INVENTION

The general purpose of the dehumidifier clothes dryer apparatus, described subsequently in greater detail, is to provide a dehumidifier clothes dryer apparatus which has many novel features that result in an improved dehumidifier clothes dryer apparatus which is not anticipated, rendered obvious, suggested, or even implied by prior art, either alone or in combination thereof.

To attain this, the dehumidifier clothes dryer apparatus provides for drying clothes with a closed loop air system. The system does not require an external air source, nor does the system require an exhaust. By providing closed loop air operation, the apparatus is not constrained as to location, whereas exhausted dryers are. The compressor system provides for condensing moisture from air passed through the clothes within the drum. The apparatus is equipped with a sump tank for condensate collection. Optionally, a sump pump with float controlled operation is provided. The compressor of the system operates with known refrigerant gasses. Dual lint traps with optional removable filters insure proper operation of the system. An optional accessory heating coil is provided. Due to the relatively low energy requirements of the apparatus, 110 volt operation is an added feature.

Thus has been broadly outlined the more important features of the improved dehumidifier clothes dryer apparatus so that the detailed description thereof that follows may be better understood and in order that the present contribution to the art may be better appreciated.

An object of the dehumidifier clothes dryer apparatus is to operate with minimal energy expenditure.

Another object of the dehumidifier clothes dryer apparatus is to operate on 110 volts.

A further object of the dehumidifier clothes dryer apparatus is to operate with minimal heat generation.

An added object of the dehumidifier clothes dryer apparatus is to operate on a closed loop air system.

And, an object of the dehumidifier clothes dryer apparatus is to capture water from the clothes drying process.

Additionally, an object of the dehumidifier clothes dryer apparatus is to provide an optional air heating element.

Still another object of the dehumidifier clothes dryer apparatus is to effectively remove lint from the system.

These together with additional objects, features and advantages of the improved dehumidifier clothes dryer apparatus will be readily apparent to those of ordinary skill in the art upon reading the following detailed description of presently preferred, but nonetheless illustrative, embodiments of the improved dehumidifier clothes dryer apparatus when taken in conjunction with the accompanying drawings.

In this respect, before explaining the current embodiments of the improved dehumidifier clothes dryer apparatus in detail, it is to be understood that the dehumidifier clothes dryer apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved dehumidifier clothes dryer apparatus. It is therefore important that the claims be regarded as including such equivalent constructions insofar as they do not depart from the spirit and scope of the dehumidifier clothes dryer apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the dehumidifier clothes dryer apparatus generally designated by the reference number 10 will be described.

Figure 1:
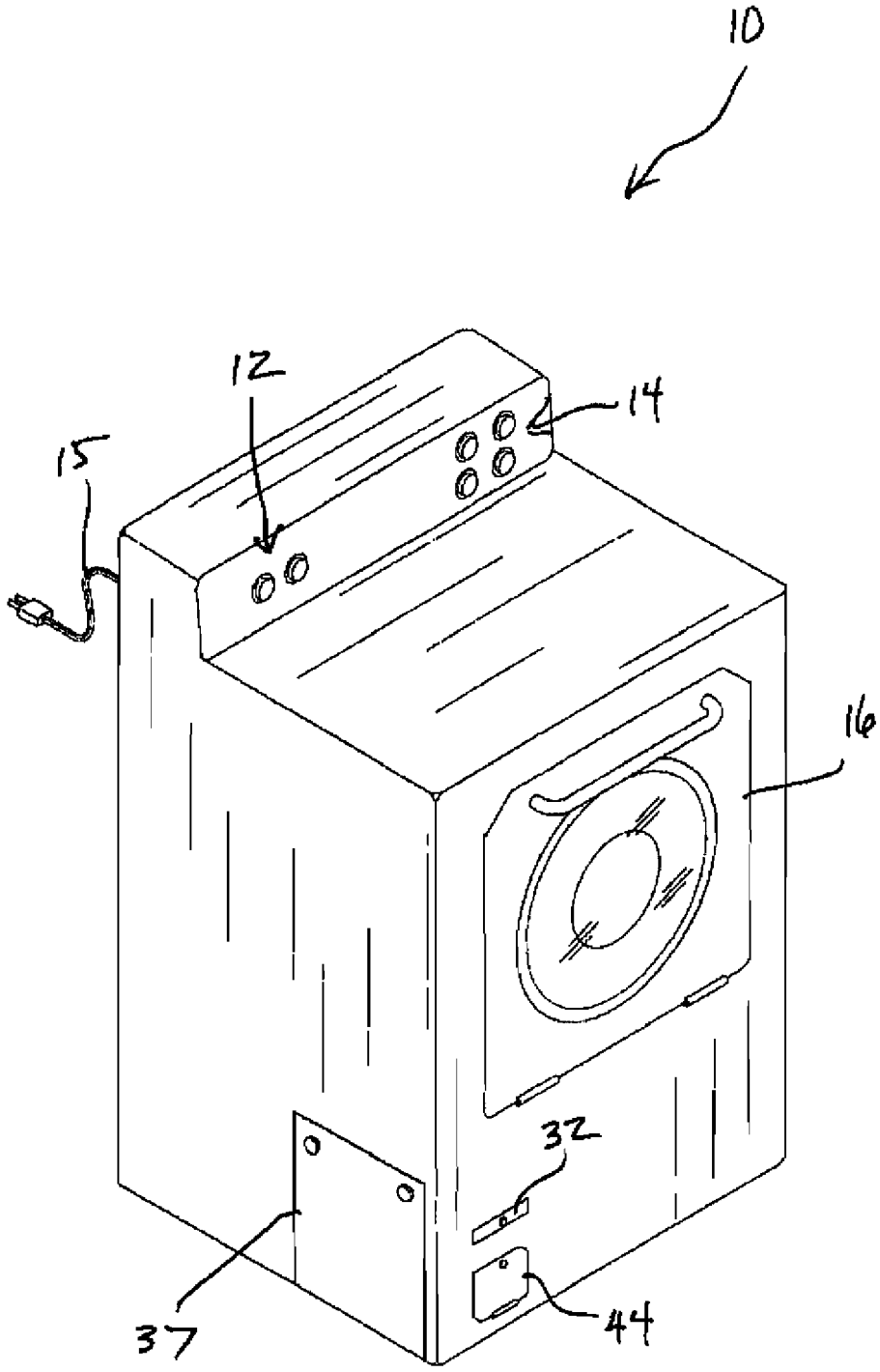
FIG. 1 is a perspective view.
Figure 2:
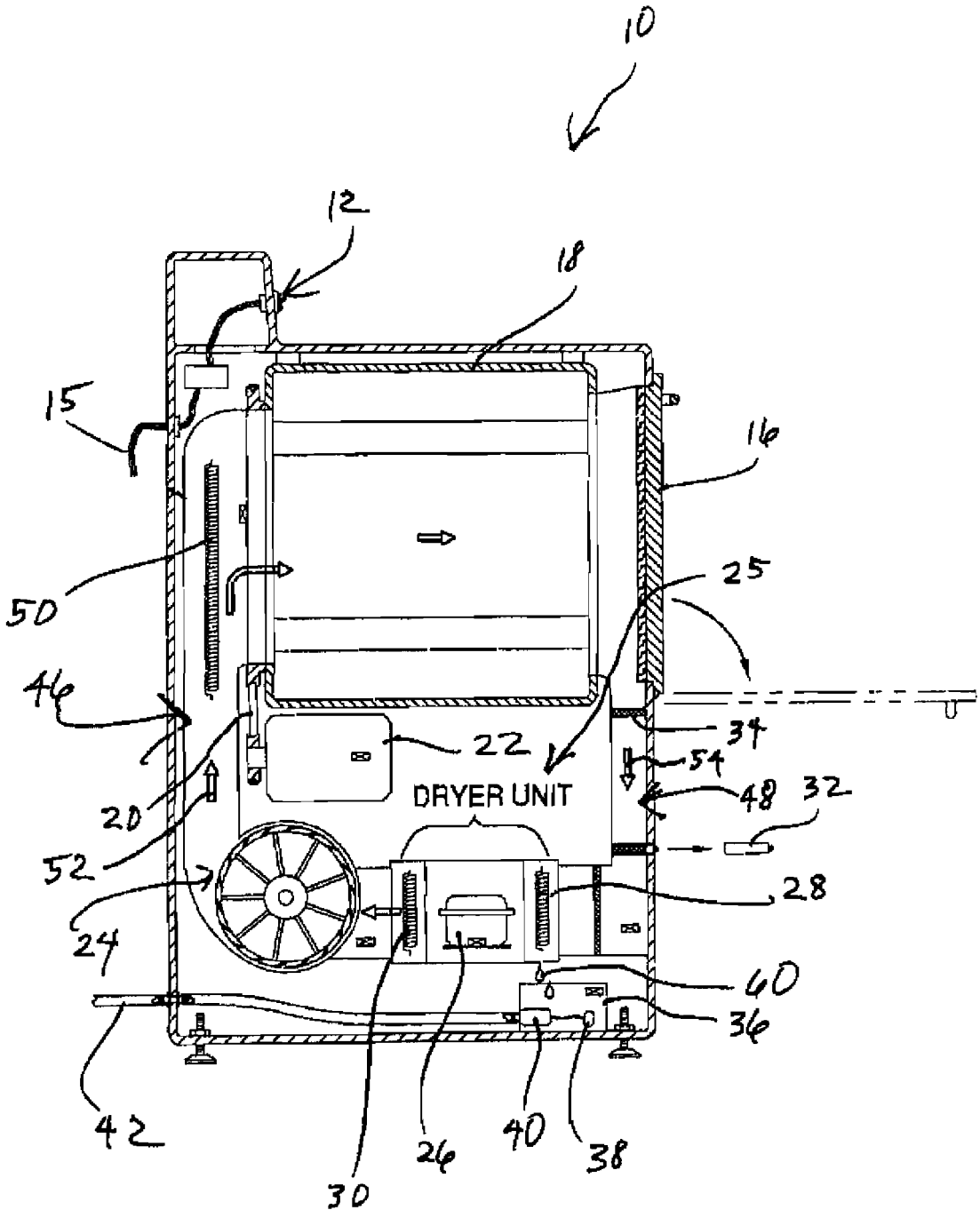
FIG. 2 is a cross sectional view.
Figure 3:
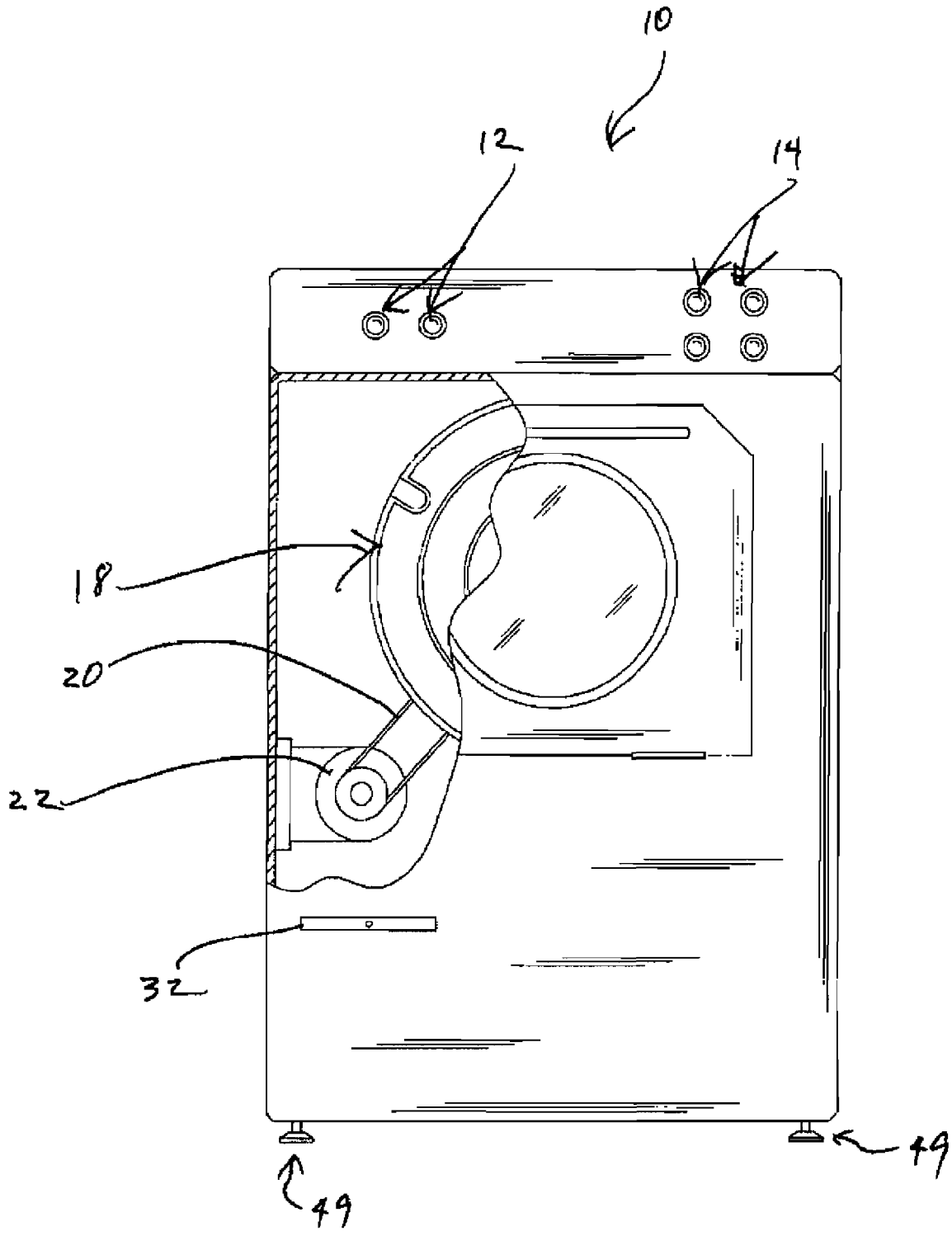
FIG. 3 is a partial cross sectional front elevation view.

Referring to FIGS. 1 and 2, the dehumidifying clothes dryer apparatus 10 has a closed loop drying air system. The apparatus 10 partially comprises design and components known in the art. The external door 16 accesses the internally housed drum 18, typifying such known art elements. The drum 18 is driven by a belt 20. The belt 20 is driven by the electric motor 22, which comprise other elements known in the art. The drum 18 removably contains the clothes for drying. On/off controls 12 are provided on the exterior of the apparatus 10. Temperature, timer, speed, and accessory heat controls 14 are also provided on the exterior of the apparatus 10. The power cord 15 connects the apparatus 10 to electrical power. The apparatus 10 is electrically powered. Leveling feet 49 are provided at all four corners of the bottom of the apparatus 10. Atypical elements of the apparatus 10 partially include secondary lint tray 32 with removable filter (not shown). An sump access 37 is provided proximal to the bottom of the apparatus 10. An additional access door 44 is provided, also on the exterior and proximal to the bottom of the apparatus 10.

Referring to FIG. 2, the dry air passage 46 is disposed within the apparatus 10 and is in communication with the back side of the drum 18. The accessory resistance heating element 50 is optionally disposed in the dry air passage 46. The moist air passage 48 is in communication with the front of the drum 18. The primary lint trap 34 is disposed in the moist air passage 48. The primary lint trap 34 optionally contains a removable filter (not shown). The primary lint trap 34 is accessible with the door 16 in the open position. The secondary lint tap 32 is disposed in the moist air passage 48 below the primary lint trap 34. The secondary lint trap 32 is removable via the front of the apparatus 10. The secondary lint trap 32 further optionally comprises a removable lint filter (not shown). Dual lint traps 32 and 34 thereby insure lint removal. Lint buildup is a primary problem in clothes dryers. Proper and complete lint removal is essential to correct operation of the closed air system of the apparatus.

The dryer unit 25 is in communication with the moist air passage 48 and the dry air passage 46. The dryer unit 25 comprises the compressor 26. The compressor 26 is isolated within the unit 25. The evaporator coil 28 is disposed within the unit 25 in the pathway of the incoming moist air 54 from the moist air passage 48. The gas medium used by the system 25 cools the evaporator coil 28 via an expansion valve (not shown) providing controlled expansion of gas compressed by the compressor 26. The cooled evaporator coil 28 condenses water from wet clothes within the drum 18. Water leaves the unit 25 via the drain (not shown) as condensate 60. Conversely, the warming coil 30 is disposed within the unit 25 opposite the evaporator coil 28. Gas compressed by the compressor 26 is warmed, thereby providing warmed dry air 52 pulled by the fan 24 and forced through the dry air passage 46. Dry warmed air 52 enters the drum 18 to dry clothes therein.

The sump tank 36 is provided below the dryer unit 25. The sump tank 36 collects condensate 60 from the dryer unit 25 drain. The sump tank 36 is removable for emptying. Another embodiment of the apparatus 10 provides the pump 40 for removing sump tank 36 condensate 60. The drain hose 42 provides for water outlet from the sump tank 36 and pump 40. The float assembly 38 provides for selective operation of the pump 40. By setting the float assembly 38, the pump 40 operates only when needed, and not continually.

Figure 4:
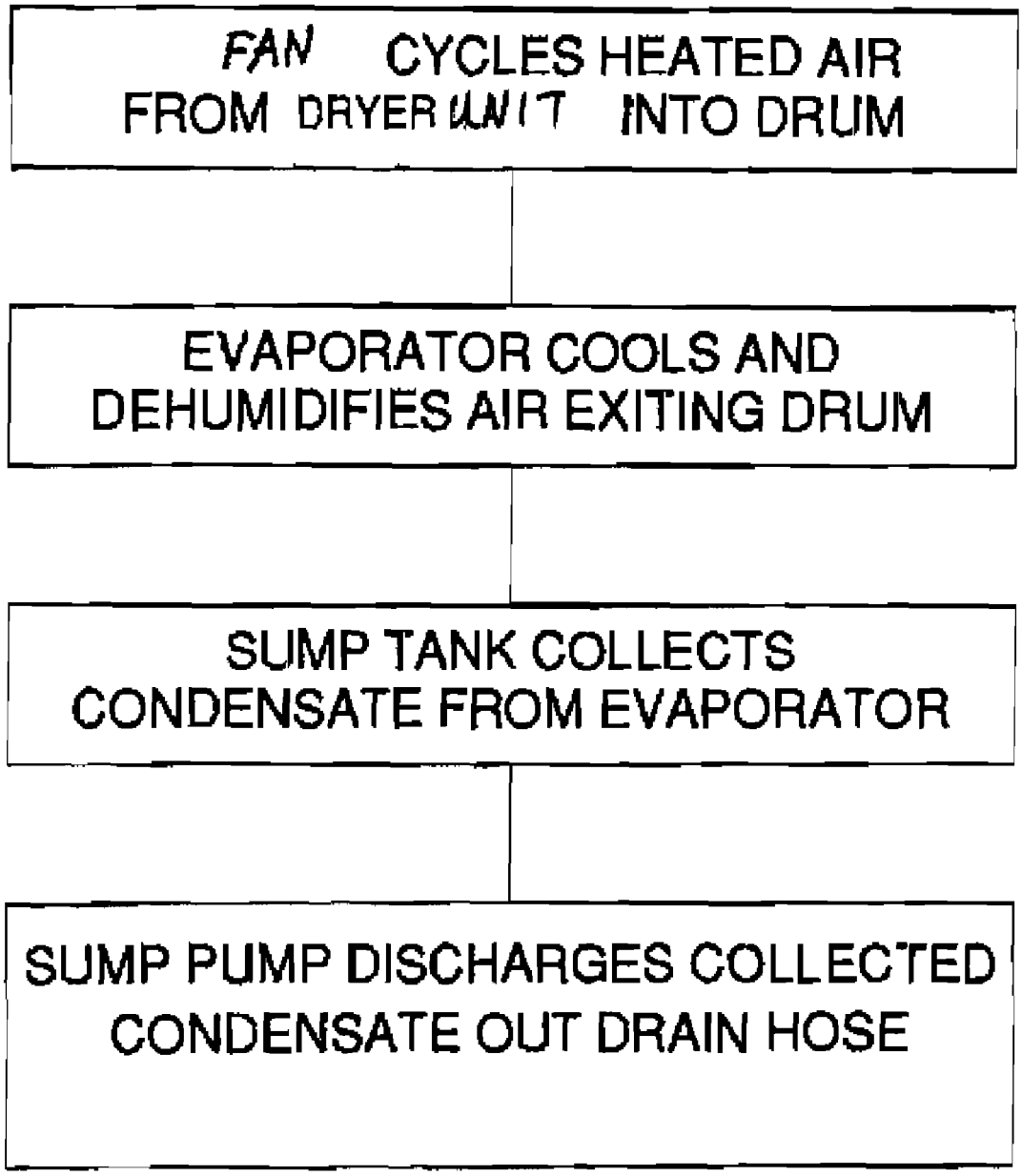
FIG. 4 is schematic block diagram of operation of the apparatus.

In view of FIG. 4, the fan 24 cycles dry air 52 heated by the warming coil 30, and optionally by the accessory heating coil 50, into the drum 18. The fan 24 further forces moist air 54 from the drum 18 and thence across the evaporator coil 28, thereby dehumidifying the moist air 54. The sump tank 36 collects condensate 60 from the system. The sump pump 40 discharges condensate 60 from the apparatus 10 via the drain hose 42.

With respect to the above description then, it is to be realized that the optimum dimensional relationships for the parts of the dehumidifier clothes dryer apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the dehumidifier clothes dryer apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the dehumidifier clothes dryer apparatus may be used.

Therefore, the foregoing is considered as illustrative only of the principles of the dehumidifier clothes dryer apparatus. Further, since numerous modifications and changes will readily occur to those skilled in the art, it is not desired to limit the dehumidifier clothes dryer apparatus to the exact construction and operation shown and described, and accordingly, all suitable modifications and equivalents may be resorted to, falling within the scope of the dehumidifier clothes dryer apparatus.

What is claimed is:

1. A dehumidifying clothes dryer apparatus having a closed loop air system, comprising:
- a motor driven rotatable drum for containing the clothes;
- a door for accessing the drum;
- a dry air passage in communication with the drum;
- a moist air passage in communication with the drum;
- a primary lint trap in the moist air passage;
- a secondary lint trap in the moist air passage;
- a dryer unit in communication with the moist air passage and the dry air passage, the dryer unit comprising:
  - a compressor isolated within the unit;
  - a evaporator coil;
  - a warming coil;
  - an expansion valve;
  - a drain;
- an electric fan for moving air through the air system;
- a sump tank for collection of water from the dryer unit drain;
- on/off controls;
- temperature, timer, and speed controls;
- a power cord for accessing electrical power.

2. The apparatus in claim 1 wherein the primary lint trap further comprises a removable lint filter.

3. The apparatus in claim 1 wherein the secondary lint trap further comprises a removable lint filter.

4. The apparatus in claim 2 wherein the secondary lint trap further comprises a removable lint filter.

5. The apparatus in claim 1 wherein the sump tank is removable.

6. The apparatus in claim 2 wherein the sump tank is removable.

7. The apparatus in claim 3 wherein the sump tank is removable.

8. The apparatus in claim 4 wherein the sump tank is removable.

9. The apparatus in claim 5 wherein the sump tank further comprises a pump for removing sump water;
- a drain hose for water outlet from the apparatus;
- a float assembly for selective operation of the pump.

10. The apparatus in claim 6 wherein the sump tank further comprises a pump for removing sump water;

a drain hose for water outlet from the apparatus;

a float assembly for selective operation of the pump.

11. The apparatus in claim 7 wherein the sump tank further comprises a pump for removing sump water;

a drain hose for water outlet from the apparatus;

a float assembly for selective operation of the pump.

12. The apparatus in claim 8 wherein the sump tank further comprises a pump for removing sump water;

a drain hose for water outlet from the apparatus;

a float assembly for selective operation of the pump.

13. A dehumidifying clothes dryer apparatus having a closed loop air system, comprising:

a motor driven rotatable drum for containing the clothes;

a door for accessing the drum;

a dry air passage in communication with the drum;

a resistance heating element in the dry air passage;

a moist air passage in communication with the drum;

a primary lint trap in the moist air passage;

a secondary lint trap in the moist air passage;

a dryer unit in communication with the moist air passage and the dry air passage, the dryer unit comprising:

a compressor isolated within the unit;

a evaporator coil;

a warming coil;

an expansion valve;

a drain;

an electric fan for moving air through the air system;

a sump tank for collection of water from the dryer unit drain;

on/off controls;

temperature, timer, and speed controls;

a power cord for accessing electrical power.

14. The apparatus in claim 13 wherein the primary lint trap further comprises a removable lint filter.

15. The apparatus in claim 13 wherein the secondary lint trap further comprises a removable lint filter.

16. The apparatus in claim 14 wherein the secondary lint trap further comprises a removable lint filter.

17. The apparatus in claim 16 wherein the sump tank is removable.

18. The apparatus in claim 17 wherein the sump tank further comprises a pump for removing sump water;

a drain hose for water outlet from the apparatus;

a float assembly for selective operation of the pump.

* * * * *